US005641327A

United States Patent [19]

Leas

[11] Patent Number: 5,641,327

[45] Date of Patent: Jun. 24, 1997

[54] CATALYTIC GASIFICATION PROCESS AND SYSTEM FOR PRODUCING MEDIUM GRADE BTU GAS

[76] Inventor: Arnold M. Leas, 122 N. 34th St., 10-C, Richmond, Ind. 47374

[21] Appl. No.: 352,833

[22] Filed: Dec. 2, 1994

[51] Int. Cl.[6] ..... C10J 3/46

[52] U.S. Cl. ..... 48/197 R; 48/202; 48/206; 48/210

[58] Field of Search ..... 48/197 R, 202, 48/203, 206, 210, DIG. 4; 252/373; 201/12, 16, 28, 31

[56] References Cited

U.S. PATENT DOCUMENTS

| | | | |
|---|---|---|---|
| 2,582,711 | 1/1952 | Nelson | 201/31 |
| 2,607,666 | 8/1952 | Martin . | |
| 2,608,526 | 8/1952 | Rex | 201/31 |
| 2,729,598 | 1/1956 | Garbo | 201/31 |
| 2,840,462 | 6/1958 | Gorin | 48/202 |
| 3,128,164 | 4/1964 | Moritz et al. | 48/202 |
| 3,322,521 | 5/1967 | Cockerham . | |
| 3,689,240 | 9/1972 | Aldridge et al. | 48/202 |
| 3,840,354 | 10/1974 | Donath . | |
| 3,847,563 | 11/1974 | Archer et al. . | |
| 3,864,100 | 2/1975 | Blaskowski . | |
| 3,985,519 | 10/1976 | Kalina et al. | 48/202 |
| 4,118,204 | 10/1978 | Eakman et al. . | |
| 4,154,581 | 5/1979 | Nack et al. | 48/197 R |
| 4,274,839 | 6/1981 | Leas | 48/202 |
| 4,303,415 | 12/1981 | Summers . | |
| 4,331,529 | 5/1982 | Lambert et al. . | |
| 4,348,487 | 9/1982 | Goldstein et al. . | |
| 4,432,773 | 2/1984 | Euker, Jr. et al. . | |
| 4,555,249 | 11/1985 | Leas | 48/62 R |
| 4,617,027 | 10/1986 | Lang . | |
| 4,682,986 | 7/1987 | Lee et al. . | |
| 4,720,289 | 1/1988 | Vaugh et al. . | |
| 4,799,937 | 1/1989 | Nieminen . | |
| 4,917,024 | 4/1990 | Marten et al. . | |
| 4,936,874 | 6/1990 | Eriksson et al. . | |
| 5,243,922 | 9/1993 | Rehmat et al. | 48/210 |

*Primary Examiner*—Timothy McMahon
*Attorney, Agent, or Firm*—Bradford E. Kile

[57] ABSTRACT

A catalytic gasification process and system for producing medium grade BTU gas including a gasification reactor having an inner air gasification zone, an outer steam gasification zone, a synthetic coal reaction zone, and an upper lime treating zone. The process and system of the present invention further includes a synthetic coal heating vessel which provides superheated recycled synthetic coal to the gasification reactor and a limestone treating vessel which provides superheated air and $CO_2$ to the gasification reactor. The novel process and system of the present invention provides for the production of a medium grade BTU gas and several commercially valuable by-products with virtually no solid or liquid waste products.

18 Claims, 2 Drawing Sheets

MEDIUM BTU GAS 84
GAS 70
LIME 72
LIMESTONE 74
SYN-COAL 62
N2 & CO2 65
LIMESTONE 74
SYN-COAL 62
ASH 98
LIME 72
AIR 64
HOT AIR + CO2 34
STEAM 50
CO2 60
SYN-COAL 42
SYN-COAL 26
REC. REAG. 104
HEAVY METALS 100
10
12
13
14
15
16
18
19
20
22
24
28
30
32
36
38
40
44
46
48
50
52
54
56
58
63
66
68
76
78
80
82
86
88
90
92
94
96
102
106
A
B

CATALYTIC GASIFICATION PROCESS AND SYSTEM FOR PRODUCING MEDIUM GRADE BTU GAS

BACKGROUND OF THE INVENTION

The present invention relates to an improved process and apparatus for producing a useful gas from solid fuels. Specifically, the invention relates to a novel process and apparatus for producing a medium BTU clean gas from a solid fuel, such as coal, without manufactured oxygen. Moreover, the process and apparatus provides for the production of other products having direct commercial utility with virtually no solid or liquid waste.

Coal is the world's most abundant fuel resource. However, coal has limited commercial applications as an energy source due to its many practical limitations such as difficulties of transport and incompatibility with power generating devices.

Coal gasification processes have been developed which attempt to transform the coal from a carbonaceous solid fuel to a gas fuel which has much more practical utility. Such a system, for example, was disclosed in my U.S. Pat. No. 4,555,249 for "Process for Gasification of coal and Organic Solid Wastes" and U.S. Pat. No. 4,274,839 for "Process for Gasification of Coal and Organic Wastes" which are hereby incorporated-by-reference. Generally, gasification processes provide a means for converting combustible organic materials such as coal, wood, tar sand, shale oil, and municipal, agriculture or industrial waste into a gas end product typically consisting of hydrogen or methane gas. The gas end product is then commonly utilized in a downstream phase of the process. For example, the gas product may be used to produce steam for the production of electricity or heating by passing the hot gases through a steam generation zone. Moreover, the production gases are often utilized in a downstream chemical process for further production. If the gas which is produced is a high grade gaseous stream it may be recovered for direct commercial use as a fuel energy source.

In order to produce a gaseous end product which has direct commercial utility—for example to drive a gas turbine or as a clean compression fuel source for use in an automobile engine—the gas end product must have a useful BTU level or grade. In this, a clean high BTU grade gas (viz. approximately 300 BTU/C.F.) is most preferable. However, a clean medium BTU grade (viz. approximately 200–275 BTU/C.F.) gas is also sufficient as a energy source for direct commercial uses. Significantly, however, a low BTU gas (viz. approximately 125–175 BTU/C.F.) is not a useful gaseous product in direct commercial applications. Moreover, a gas product of any grade is not acceptable if it contains contaminates which adversely affect its combustion properties. For example, a gas end product which contains large amounts of carbon dioxide, nitrogen, and sulfur compounds such as hydrogen sulfide ("sulfur gas") can not be used as a direct energy source for commercial applications. A gas end product having large amounts of contaminates is not acceptable in direct commercial applications, for example in gas turbines, because it will produce flame-out and stoppage. Moreover, the combustion by-products of a contaminated gas will produce environmentally unsafe by-products (e.g. $SO_x$ gas, $NO_x$ gas, particulate, etc.) which are unacceptable in commercial applications.

Common to all gasification techniques is the need for in process oxygen to carry out the necessary reactions (viz. to react with the carbon of the carbonaceous solid fuel). As a general matter, if the source of in-process oxygen for the gasification process is derived from manufactured oxygen, then the gaseous end product will be a high grade BTU gas. Conversely, if the source of in-process oxygen for the gasification process is derived from air or steam, then the gaseous end product will be a low grade BTU gas. For example, certain gasification processes currently employed by Texaco, Dow, and Shell require a high amount of in-process oxygen in order to produce a useful BTU gas end product. Although the gas end products of the Texaco, Dow, and Shell processes are high grade BTU gases (viz. approximately 300 BTU/C.F.), the processes require the use of manufactured oxygen. The gasification process currently employed by British Gas uses air and steam as a source of in-process oxygen, but the gas end product is a low grade BTU gas having limited commercial utility. The problem with utilizing manufactured oxygen as the source of in-process oxygen is that it has a commercially prohibitive cost. Manufactured oxygen can be one of the most significant costs in a gasification process. Manufactured oxygen is typically produced through a cryogenic method wherein a volume of air is reduced to extremely low temperatures—in the order of 360° F. below zero—whereby the $O_2$ is liquidized and removed in a pure liquid form. Current market rates for manufactured oxygen are approximately from five times the cost of on-site coal. Moreover, an oxygen gasification process requires about one ton of oxygen for every ton of coal. Accordingly, the high cost of manufactured oxygen adversely affects the economic efficiency of a gasification process. A common denominator of all gasification systems is that they must be economical to operate. Gasification systems have large initial capital investment cost and as a result, a low process efficiency is unacceptable to gasification management teams. In this, coal deposit owners are discouraged form using gasification techniques which are capable of producing a high BTU gas for direct commercial applications—for example to drive a gas turbine or as a clean compression fuel source for use in an automobile engine—which prevents the expansion of use of clean energy sources by the public. For example, a ready and cost effective source of compressed hydrogen would encourage automobile manufacturers to develop some hydrogen fueled automobiles. As noted, in order to effectively operate gas turbines, a medium to high grade BTU gas is required. Electrical power producers are discouraged by the high cost of coal gasification and have in the past almost exclusively utilized natural gas sources.

Manufactured oxygen has been the preferable source of process oxygen because it not only provides the necessary reaction content for the creation of a high grade BTU gas, but an excess amount of non-reacted $O_2$ is burned in order to create additional and necessary process heat. In order to eliminate the need for manufactured oxygen attempts have been made to use a process catalyst which accelerates the process reactions in order to provide beneficial temperature affects. One such attempt has been made by Exxon Research and Engineering Co. wherein the process reactions are carried out in the presence of a carbon-alkali metal catalyst. However, this Exxon gasification process and reaction catalyst have proven ineffective and problematic. The carbon-alkali metal catalyst of the prior art consist of an alkali metal (e.g. Na) with impregnated carbon. The alkali and carbon, however, are not chemically bonded, but merely coexist in their respective forms. Typically, the catalyst, in liquid form, is sprayed onto a fine coal and delivered to a reaction vessel. The inherent problem with the prior art catalyst is that once the gasification reactions are complete, the catalyst must be separated from the reaction products, such as coal ash, for disposal and/or recycling. This separation step involves the use of complex reactor designs and additional hardware which not only increase the complexity of the system, but increase capital cost significantly. As such, the prior art gasification systems which utilize reaction catalysts have proven to be commercially unacceptable. The prior art gasification systems have failed to provide a recycle reagent which serve as a process catalyst while providing superior recycling and density properties.

Prior art gasification methods and systems have proven disadvantageous for several other significant reasons. First, the prior art thermal gasification systems and methods require very high operating temperatures—approximately 2500° to 2800° F.—in order for the process reactions to occur. At these extreme operating temperatures, the iron based reaction vessels will melt if cooling mechanisms are not in place. Typically, such mechanism include complex and expensive vessel insulation schemes and/or heat exchanger cooling. Moreover, the high reaction temperatures require the use of expensive iron alloys—such as 310 (Cr/Ni) S.S. as fabrication material for the reaction vessels.

The prior art methods and systems have relatively low thermal process efficiencies. The prior art methods and systems have been unable to maximize the extent of gasification which occurs during the process thereby obtaining relatively low conversion efficiencies. The prior art methods and systems produce environmentally unsafe by-product waste which requires costly post process handling. The prior art techniques have been unable to produce commercially useful by-products from the gasification process. The prior art gasification methods and systems require the manufacturing of special process modules and hardware which increase production cost and make it more difficult to relocate from one mine site to another as resources change. The prior art systems which utilize manufactured oxygen in the production of high grade BTU gas, produce a product gas having very high exit temperatures which can not be directly used in gas turbines.

The difficulties and limitations suggested in the preceding are not intended to be exhaustive, but rather are among many which demonstrate that although significant attention has been devoted to solid gasification methods and systems, such methods and systems appearing in the past will admit to worthwhile improvement.

OBJECTS AND BRIEF SUMMARY OF THE INVENTION

It is therefore a general object of the invention to provide a novel solid gasification process and system which will obviate or minimize difficulties of the type previously described.

It is another general object of the invention to provide a novel solid gasification process and system which provides for the production of a medium grade BTU gas (e.g. approximately 225 BTU/C.F.) without manufactured oxygen.

It is another general object of the invention to provide a novel solid gasification process and system which provides for the production of a gas end product having direct commercial use—for example to drive a gas turbine or as a clean compression fuel source for use in an automobile engine—without the need for further downstream processing.

It is a specific object of the invention to provide a solid gasification process and system which utilizes a catalytic process reagent which optimizes process parameters.

It is another specific object of the invention to provide a solid gasification process and system which utilizes a catalytic reagent which does not require post reaction separation steps.

It is yet another specific object of the invention to provide a solid gasification process and system which utilizes a catalytic process reagent having optimal density and recycling characteristics.

It is still another specific object of the invention to provide a solid gasification process and system which operates under substantially reduced reaction temperatures.

It is yet another specific object of the invention to provide a solid gasification process and system which substantially increases the solid-gas conversion efficiency over prior art systems.

It is another specific object of the invention to provide a solid gasification process and system which substantially decreases production cost over prior art systems.

It is yet another specific object of the invention to provide a solid gasification process and system which provides for the production of useful and commercially viable by-products.

It is still another specific object of the invention to provide a solid gasification process and system which which eliminates and/or significantly reduces the formation of environmentally harmful by-products.

It is yet another specific object of the invention to provide a solid gasification process and system wherein the primary reactions are contained within a single reaction containment vessel thereby optimizing reaction heat transfer and reducing production cost.

It is still yet another specific object of the invention to provide a solid gasification process and system which utilizes standard petroleum refinery process hardware thereby removing the need for specialized component manufacturing.

It is still yet another specific object of the invention to provide a solid gasification process and system which is designed such that removal of useful reaction products is easily accomplished without the need for special separating devices.

It is still yet another specific object of the invention to provide a solid gasification process and system which includes further downstream operations to produce additional products having direct commercial utility.

BRIEF SUMMARY OF A PREFERRED EMBODIMENT OF THE INVENTION

A preferred embodiment of the invention which is intended to accomplish at least some of the foregoing objects comprises catalytic gasification process and system for producing medium grade BTU gas including a gasification reactor having an inner air gasification zone, an outer steam gasification zone, a synthetic coal reaction zone, and an upper lime treating zone. The novel process and system of the present invention utilizes a catalytic reagent that serves to optimize reaction parameters and process flow and which does not require post reaction separation steps. The novel process and system of the present invention provides for the production of a medium grade BTU gas and several commercially valuable by-products with virtually no solid or liquid waste products.

DRAWINGS

Other objects and advantages of the present invention will become apparent from the following detailed description of a preferred embodiment thereof taken in conjunction with the accompanying drawings, wherein.

DETAILED DESCRIPTION

Figure 1:
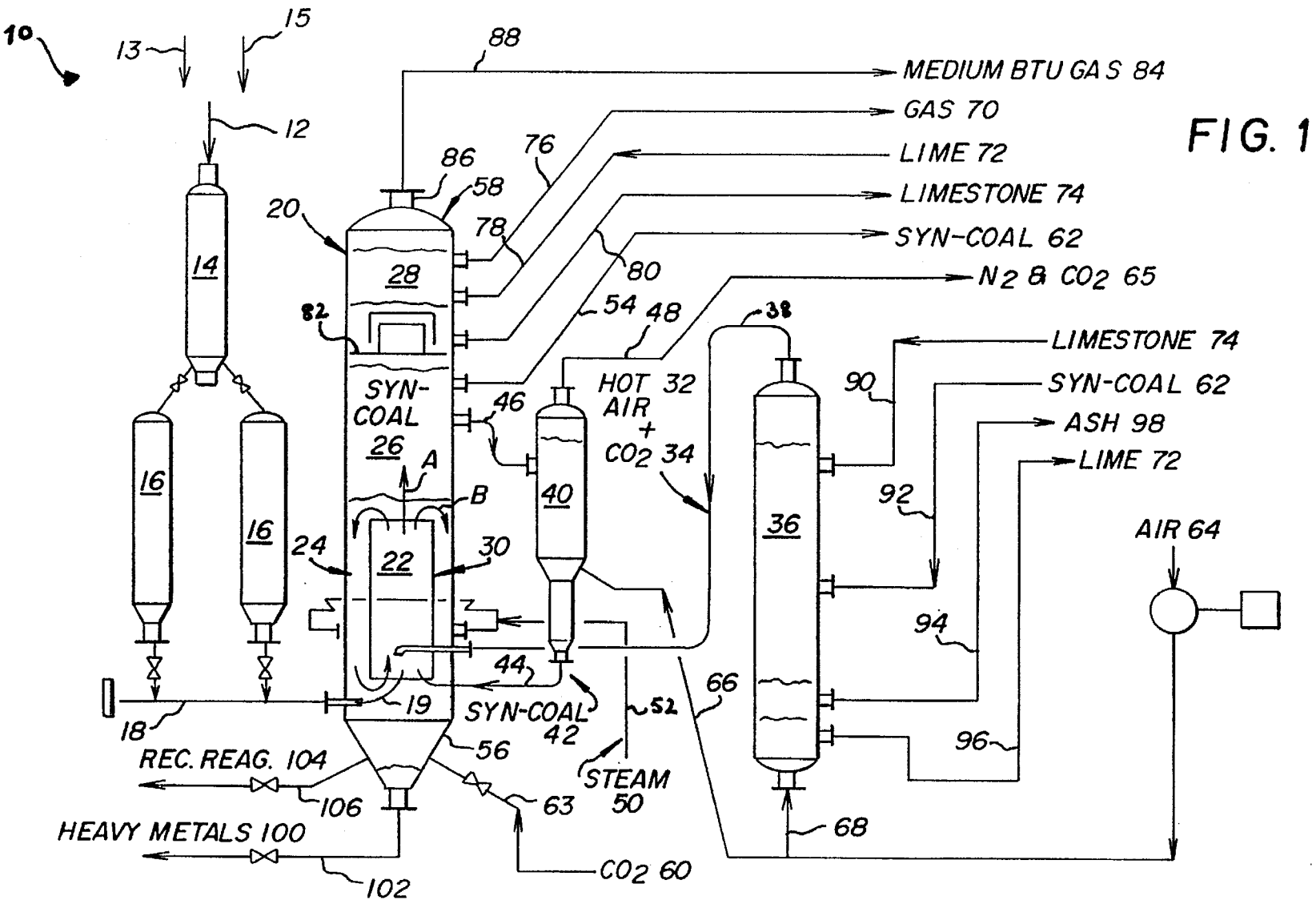
FIG. 1 is a schematic drawing of primary components of the solid gasification process and system of the present invention.

Referring now to the drawings and particularly to FIG. 1, there is shown primary components of the solid gasification system 10 of the present invention. As shown, the process reactants 12 are conveyed into the elevated surge hopper 14. In the preferred embodiment, the combined process reactants 12 consist primarily of fine coal 13 and a process recycle reagent 15. The blended process reactants 12 have been previously treated in an upstream treatment process not depicted in the drawings. Specifically, raw coal is first delivered from a coal mine and conveyed into a hopper where it is pulverized to form a fine coal product which includes coal ash. The fine coal product is then conveyed from the hopper into a blender where it is mixed with a recycle reagent. The blended fine coal and recycle reagent is delivered as the process reactants 12 to the surge hopper 14 as shown in FIG. 1. The process reactant 12 are then delivered to at least one, but preferably two, lock bins 16. The lock bins 16 serve as a holding vessel for the reactants 12 and assure that a ready supply of reactants 12 is always available for delivery to the gasification vessel 20. Preferably, lock bins 16 are air pressurized vessels which assures sufficient flow of the reactants 12 into the screw drive assembly 18. Vessel pressure is preferably in the order of 180 p.s.i.g. which assures that the reactants 12 are driven upstream. The surge hopper 14 is located in a position vertically above the lock bins 16 in order to assist in the flow of the reactants 12 as attributed by gravity. The process reactants 12 are delivered from the lock bins 16 into the variable screw drive apparatus 18 which conveys the reactants upon controlled demand into the bottom of the gasification vessel 20. Other conveying devices are considered to be within the scope of the invention.

The gasification vessel 20 is a single shell design and provides significant advantage over prior art vessels. The gasification vessel 20 is designed to contain four process reaction zones 22, 24, 26, and 28 which operate in a related and synergistic fashion to provide the improved and novel results of the present invention. The first inner process reaction zone 22 is located in a beta-leg of the gasification vessel 20. The second outer process reaction zone 24 is located in a gamma-leg of the gasification vessel 20. The third reaction zone 26 is a deep fluidized bed of synthetic coal ("syn-coal") floating on top of an internal recycle reagent 15 as more completely described below. A fourth reaction zone 28 is located in an compartment adjoining the third reaction zone 26.

The beta-leg of the gasification vessel 20 is defined by an annular sleeve 30 preferably manufactured from stainless steel. The annular sleeve 30 separates the first inner reaction zone 22 and the second outer reaction zone 24. The process reactants 12, consisting of blended pulverized coal 13 and recycle reagent 15, are delivered into the bottom of the beta-leg 22 via line 19 as shown in FIG. 1. The beta-leg 22 is further supplied with hot air 32 and hot $CO_2$ 34 delivered from the limestone calcinator 36 via line 38 as more fully described below. Heated recycled synthetic coal 42 is delivered from heating vessel 40, via line 44, to the beta-leg which houses the inner reaction zone 22. The primary reaction which occurs in the first inner reaction zone 22 is air gasification of the fine coal 13 which occur as follows:

$$2\ C+AIR\ (O_2) \rightarrow 2\ CO+N_2+HEAT \quad (1)$$

The hot air 32 and hot $CO_2$ 34 is supplied from the limestone calcinator 36 under pressure, preferably in the order of 180 p.s.i., which is directed at the fine coal 13. In this, the carbon is oxidized and uniformly redeposited onto the recycle reagent 15, the clean coal ash, and the recycle syn-coal 42 as the superheated air 32 strikes the incoming dried pulverized coal 13, recycle reagent 15, and recycled syn-coal 42. As indicated, the reaction (1) occurring in the first inner reaction zone 22 is an exothermic reaction which provides the reaction heat necessary for the endothermic chemical reaction (2) occurring in the second outer reaction zone 24. The inner reaction zone forms a fluidized bed of solid and gas moving upward. The superheated air 32 causes the carbon from the pulverized coal 13 to be redeposited on the recycled syn-coal 42 which flows upward into the syn-coal fluidized bed 26 as indicated by arrow A. The superheated air 32 also causes the carbon from the pulverized coal 13 to be deposited on the coal ash, a product of pulverized coal 13, thereby forming syn-coal which travels upward and into the fluidized bed 26 in the same manner as the recycled syn-coal 42. The superheated air further causes the carbon from the pulverized coal 13 to be deposited on the fluidized recycle reagent which flows upward in the direction of arrow A, but due to its higher density, overflows into the outer reaction zone 24. In this, the recycle reagent circulates between the inner reaction zone 22 and the outer reaction zone 24 as indicated by arrows B. The superheated air gasification identified by reaction (1) produces a low grade BTU gas in the order of 120–150 BTU/C.F.

The gamma-leg 24 of the gasification 20 is also defined by the cylindrical stainless steel skirt 30 and consist of an outer annular reaction zone. Super heated steam 50 is delivered via line 52 from a steam generation plant (not shown). The gamma-leg 24 is further supplied with heated recycle reagent having carbon deposited thereon which emerges from the inner reaction zone as indicated by arrows B. The heated recycle reagent having deposited carbon operates in a percolation downward flow through the outer reaction zone 24 at a relatively reduced velocity as compared with the inner reaction zone 22. The gases produced in the outer reaction zone, however, flow upward into the third reaction zone 26. The primary chemical reaction occurring in the outer reaction zone 24 is steam gasification defined as follows:

$$C+H_2O+HEAT \rightarrow H_2+CO \quad (2)$$

The endothermic reaction (2) occurring in the outer reaction zone 24 produces a high grade BTU gas in the order of 300–325 BTU/C.F.

The novel gasification process and system of the present invention includes the coordinated interaction between the inner and outer reaction zones which provides advantageous process result. Specifically, in the inner reaction zone the upward fluidized bed uses air to oxidize carbon, redeposit carbon on the clean coal ash (thereby forming synthetic coal) and recycled synthetic coal 42, produce a low grade BTU gas, and to provide exothermic heat in accordance with reaction (1). In the outer zone 24 the downward percolation flowing bed uses steam under endothermic heat to produce a high grade BTU gas in accordance with reaction (2). The process recycle reagent 15 serves an important function in this regard. Specifically, the proper recycle reagent must be selected which allows for circulation through both the inner and outer reaction zone in order to balance the exothermic heat of the inner reaction (1) and the endothermic heat of the outer reaction (2). Moreover, the recycle reagent must be capable of being deposited with carbon originating from the coal. In this, the carbonated recycle reagent flowing from the inner reaction zone 22 as indicated by arrow B carries the carbon necessary for reaction into the outer reaction zone 24. The recycle reagent should have an intermediate density which is greater than that of synthetic coal in order to allow for the formation of the floating synthetic coal bed 26 on the one hand, and light enough to allow for fluidization on the other hand. The preferred process reagent of the present invention is sillimanite $Al_2O_3 \cdot SiO_2$. Sillimanite has a density in the order of 50 lbs/c.f. The sillimanite is injected and chemically combined with a catalytic agent in order to produce a catalytic process reagent. Various catalytic agents may be used such as sodium to yield $Al_2O_3 \cdot SiO_2 \cdot Na_2O$ or potassium to yield $Al_2O_3 \cdot SiO_2 \cdot K_2O$. However, the concentration of the alkaline injection is small in order to retain the primary reagent as $Al_2O_3 \cdot SiO_2$. Test have shown that the optimal weight percent for the process reagent is in the order of 75% reagent and 25% catalytic agent. Another acceptable recycle reagent is mullite $3Al_2O_3 2 \cdot SiO_2$. Mullite has a density in the order of 54 lbs/c.f. Again, pulverized mullite is treated with sodium or potassium in order to provide a catalytic reagent. Attapulgas clay can also be used as a recycle reagent with, however, increased yield in ash by-product. Other recycle reagents having properties described above are considered to be within the scope of the invention.

The recycle reagent of the present invention maintains a clean gasification reactor and facilitates the fractionation and withdrawal of several relatively pure solid valuable by-products. The catalytic recycle reagent of the present invention is a significant improvement over prior art catalytic reagents because it consists of a base material (e.g. sillimanite) having advantageous density and recycle characteristics and which chemically combines with a catalytic agent. No post reaction separation is required. In fact, the novel process and system of the present invention permits the catalytic reagent to self recycle in flowing from the first to second reactions zones due to the differential densities of the system products. In the prior art catalytic gasification processes, complex and cost prohibitive system components are necessary in order to separate the catalytic reagent from the coal ash for recycling or disposal.

The third reaction zone 26 is defined by the fluidized bed of synthetic coal. As previously noted, the fluidized bed of syn-coal is continuously stocked with re-carbonated recycled syn-coal 42 and with carbonated clean ash (i.e. syn-coal which has not yet been recycled). The fluidized bed of syn-coal floats on top of the moving recycle reagent 15 of the inner 22 and outer 24 reaction zones. Specifically, the recycle reagent has a density which is greater than that of syn-coal thereby causing the syn-coal to move upward and float on top of the recycle reagent. Syn-coal typically has a density in the order of 35 lbs/c.f. As shown in FIG. 1, a portion of the syn-coal is removed from the fluidized bed through line 46 and delivered to heating vessel 40 as more completely described below. Another portion of the syn-coal is removed from the fluidized bed through line 54 and delivered to a syn-coal conglomeration unit 108 as more completely described below with reference to FIG. 2.

The syn-coal withdrawal rates through lines 46 and 54 are controlled so as to maintain a constant deep syn-coal bed which provides for reaction zone 26. The syn-coal bed 26 is provided, in part, as a secondary reaction zone in order to react excess carbon deposited on the syn-coal with $CO_2$ gas flowing upward from the first inner reaction zone 22. The primary reaction in the syn-coal fluidized bed occurs as follows:

$$CO_2 + C + HEAT \rightarrow 2\ CO \quad (3)$$

The source of the $CO_2$ which drives reaction (3) is from the inner reaction zone 22. The $CO_2$ which rises out of the inner reaction zone 22 is derived from several sources. First, as noted, hot air 32 and $CO_2$ gas 34 is delivered into the inner reaction zone 22 from lime stone calcinator 36 via line 38. Second, in order to provide additional exothermic heat in the inner reaction zone 22, the carbon deposited on recycled syn-coal 42 and on the formed syn-coal is air oxidized to primarily produce $CO_2$. Moreover, $CO_2$ 60 is injected at the bottom 56 of the gasification vessel 20 through supply line 63 in order to establish adequate sealing between the inner 22 and outer 24 reaction zones. The unreacted $Co_2$ from these sources rises from the inner reaction zone 22 and into the third reaction zone 26 which is maintained directly above the inner 22 and outer 24 reaction zones.

The presence of a floating syn-coal fluidized bed 26 provides for advantageous results which contribute to the novel and superior process and system of the present invention. First, the unreacted carbon which has been deposited on the clean ash is reacted with $CO_2$ gas in accordance with reaction (3) to form additional high grade BTU gas (viz. approximately 300 BTU/C.F.). This is advantageous in that it increases overall system efficiency by maximizing the use of the carbonaceous fuel. Second, the controlled floating syn-coal fluidized bed allows for the withdrawal of a valuable by-product which may be put to direct use or subjected to further processing. For example, the withdrawn syn-coal 62 maybe delivered to a conglomeration unit 108 as more completely described below. Third, a portion a the syn-coal is withdrawn and delivered to a heating vessel 40 wherein the carbon of syn-coal is air oxidized and re-directed to the inner reaction zone 22 to provide additional process heat.

A portion of the syn-coal of the fluidized bed 26 is withdrawn through line 46 and delivered to reaction heating vessel 40. Compressed air 64 is delivered through line 66 into a lower portion of the vessel 40. The carbon of the syn-coal is reacted with the oxygen of the compressed air to provide the following exothermic reaction:

$$C + AIR\ (O_2) \rightarrow CO_2 + N_2 + HEAT \quad (4)$$

Reaction (4) produces a significant amount of process heat which is stored in the moving syn-coal mass and delivered, via line 44, into the inner reaction zone 22 as heated recycle syn-coal 42. The contaminate by-products of reaction (4) are typically $CO_2$ and $N_2$ 65. In utilizing a separate heating reaction vessel 40, the $CO_2$ and $N_2$ gases 65 may be easily retrieved from the top of the vessel 40 and delivered, via line 48, to a storage vessel or subjected to further processing. In this, a significant amount of process heat is created while avoiding the mixture of contaminate gas with useful grade BTU gas. Moreover, the heating vessel 40 provides for a significant amount of process operating flexibility. Specifically, the quantity and quality of the syn-coal recycled can be controlled and adjusted to accommodate the heat balance of the system. That is, if more exothermic heat is required in the inner reaction zone 22, an operator would increase the supply of heated recycle syn-coal 42.

The fourth upper reaction zone 28 serves as a hot lime treating section of the gasification vessel 20. The main purpose of the upper lime treating section 28 is to remove contaminate gas from the producer gas product. Specifically, the lime treating section 28 serves to eliminate the presence of $H_2S$ from the product gas under the following reaction:

$$H_2S+CaO \rightarrow CaS+H_2O \quad (5)$$

Hydrogen sulfide $H_2S$ gas is an undesirable sulfur by-product of coal gasification. Its presence in the product gas lowers BTU content and prevents direct commercial use. The upper lime treating zone 28 reacts the $H_2S$ with lime CaO (a carbonate of calcium) in order to create a manageable and easily removable solid by-product CaS 70. The upper lime treating zone 28 is contained in an upper section of the gasifier reaction vessel 20 and separated from the third reaction zone 26 by a connecting partition 82. Hydrogen sulfide $H_2S$ gas produced as a by-product in the inner reaction zone 22 travels into the lime treating zone 28 through partition 82. Lime 72 is delivered to the upper reaction zone 28 via supply line 78. The lime 72 is delivered from limestone calcinator 36 as a by-product of reaction (6). The lime 72 and $H_2$ gas react in accordance with reaction (5) to produce CaS and $H_2O$. Significantly, the CaS 70 has a lower density (viz. in the order of 50 lbs./c.f.) than the lime 72 (viz. in the order of 80 lbs./c.f.) and, thus, floats on top of the lime 72. In this, the CaS 72 can be easily removed as a clean by-product from the upper reaction zone 28 through withdrawal line 76. Limestone $CaCO_3$ 74 is formed in a secondary reaction of the upper reaction zone. Again, the limestone 74 has a greater density (viz. in the order of 65 lbs./c.f.) than CaS 70 and, therefore, settles on the partition 82 for removal through line 80. The withdrawn limestone 74 is transported, via line 80, to the limestone calcinator 36 for further processing as fully set forth below. The lime treating zone 28 allows for the removal of the contaminate gas $H_2S$ as a clean by-product CaS. Moreover, secondary reactions occurring in the upper reaction zone 28 provide for the removal of contaminate $CO_2$ gas in order to increase BTU content of the product gas. The upper treating zone 28 is advantageous to the overall gasification process and system 10 in that it increases the quality of the final gas product and decreases the amount of waste by-products.

The novel process and system of the present invention allows for reduction of operating pressures and temperatures. In using the novel catalytic reagent and system arrangement of the present invention, the necessary process reactions (viz. air and steam gasification) occur at substantially lower temperatures and pressures over prior art thermal systems. Specifically, operating reaction temperatures are reduced in the order of 1000° F. below prior art thermal processes. In this, the need for complex insulation and cooling systems, expensive reaction vessels, and manufactured oxygen is eliminated. The operating parameters of the gasification reactor 20 include a vessel pressure in the order of 175 p.s.i.g. and a vessel temperature profile in the order of 850°–1650° F. The temperature of the hot air 32 and $CO_2$ gas 34 is in the order of 1650°–1700° F. Generally, the results of the process of the present invention can be achieved when the reaction vessel is maintained with a pressure in the range of 150 to 200 p.s.i.g. and a temperature profile in the range of 850 to 1700° F. The temperature of the recycled syn-coal 42 delivered into the inner reaction zone is in the order of 1600°–1620° F. The $N_2$ and $CO_2$ vent gases 65 from the syn-coal heating vessel 40 are removed at a temperature in the order of 1800°–1810° F.

The product gas 84 is removed through a valve 86 located on the top of the gasifier vessel 20 and delivered, via line 88, to a storage vessel (not shown). Preferably, however, the product gas 84 is first injected through a standard commercial filter (not shown), such as a cyclone, for the removal of any unwanted solid impurities. Significantly, the product gas 84 is a medium grade BTU gas having direct commercial applicability. The product gas 84 is preferably a medium grade BTU gas having a content in the range of 200–250 BTU/C.F. The product gas 84 is derived from the mixing of the low grade BTU gas of the inner reaction zone 22 and the high grade BTU gas of the outer reaction zone 24. The BTU content of the product gas 84 will vary depending on the particular system inputs. The product gas 84 can be stored in transport vessels and transported for direct commercial use by a consumer. For example, the product gas 84 could be stored and delivered to a service station for use in automobiles having gas engines. Alternatively, the product gas 84 could be delivered directly on site to a gas turbine for the creation of electricity for delivery to the consuming public or use by manufacturing facilities. No additional costly and environmentally harmful treatment is required to be performed. Significantly, the source of in process oxygen for the process of the present invention originates from steam, $CO_2$, and air through carbon reactions. The product gas 84 of the present invention has direct commercial applications and is provided without the use of manufactured oxygen.

As previously discussed, hot air 32 and $CO_2$ 34 is delivered to the inner reaction zone 22 in order to drive reaction (1). The source of hot air 32 and $CO_2$ 34 is derived from the limestone calcinator vessel 36. The limestone calcinator vessel 36 is supplied with limestone 74 via supply line 90. The source of the limestone 74 is from make up and the upper lime treating zone 28 of the reactor vessel 20. The limestone 74 is transported, via line 80, to at least a pair of lock bins (not shown) from which supply line 90 delivers the limestone 74 into an upper portion of the reaction vessel 36. Similarly, a portion of the syn-coal 62 withdrawn from the syn-coal fluidized bed 26 of the gasifier reactor 20 is delivered, via line 54, to at least a pair of lock bins (not shown). The syn-coal is then withdrawn as needed from the lock bins and delivered, via supply line 92, to a mid-section of the reaction vessel 36 as shown in FIG. 1. Compressed air 64 is delivered, via supply line 68, to the bottom of the reaction vessel 36 as indicated in FIG. 1. The compressed air 64 is supplied from product gas 84 expanders (not shown) and a steam driven compressor (not shown) which may be designed to utilize system products depending upon client desires and the integration of outside plant facilities. The reaction vessel 36 contains the following primary reactions:

$$CaCO_3+HEAT \rightarrow CO_2+CaO \quad (6)$$

$$\text{SYN-COAL (C)+AIR (O2)} \rightarrow \text{HOT } CO_2\text{+EXCESS AIR} \quad (7)$$

The primary reaction (6) yields $CO_2$ gas and lime 72. Due to its density, the lime 72 settles on the bottom of the reaction vessel 36 as shown in FIG. 1. The lime 72 is then easily withdrawn from the vessel 36, via line 96, and delivered to a holding vessel (not shown) for temporary storage. From the holding vessel, the lime 72 is withdrawn, as necessary, and delivered, via line 78, to the lime treating zone 28 of the gasifier vessel 20. Reaction (7) produces the desired hot $CO_2$ gas and air which is captured at the top of the reaction vessel 36 and diverted, via line 38, to the inner reaction zone 22 of the gasifier 20. Coal ash 98 is an additional by-product of the reactions of the limestone calcinator vessel 36. Coal ash 98—having a density in the order of 40 lbs./c.f.—floats on top of the lime 72 in the vessel 36 and is withdrawn and delivered, via line 94, to a storage vessel (not shown). The coal ash 98 may then be delivered to the coal/reagent blending vessel (not shown) for recycling through the gasifier. The limestone calcinator provides for hot $CO_2$ gas and air ($O_2$) which are used in the gasification process. The novel system 10 is designed such that the limestone calcinator vessel 36 operably interacts with the gasifier vessel 20 to utilize the reaction by-products for the production of in process hot $CO_2$ gas and air ($O_2$).

The heavy metals 100 contained in the coal 13 settle at the bottom of the gasifier vessel 20 and are withdrawn and delivered, via line 102, to a storage vessel (not shown). The heavy metal inorganic by-products may then be safely and conveniently removed and delivered for sale or to a disposal site. The conversion of organic metals to inorganic metals facilitates the removal of coal metals 100. Furthermore, any remaining traces of coal metals are absorbed by the system reagent 15 and removed during reagent recycling. Any system reagent 15 which is not effectively delivered to the inner reaction zone 22, is withdrawn out of the bottom of the reaction vessel 20. The recycled reagent 104 is delivered, via line 106, to recycle reagent lock bin (not shown) where it may then be delivered to the coal/reagent blender (not shown) for reprocessing. The recycling of the reagent in this manner increases the over all efficiency of the gasification system 10.

Figure 2:
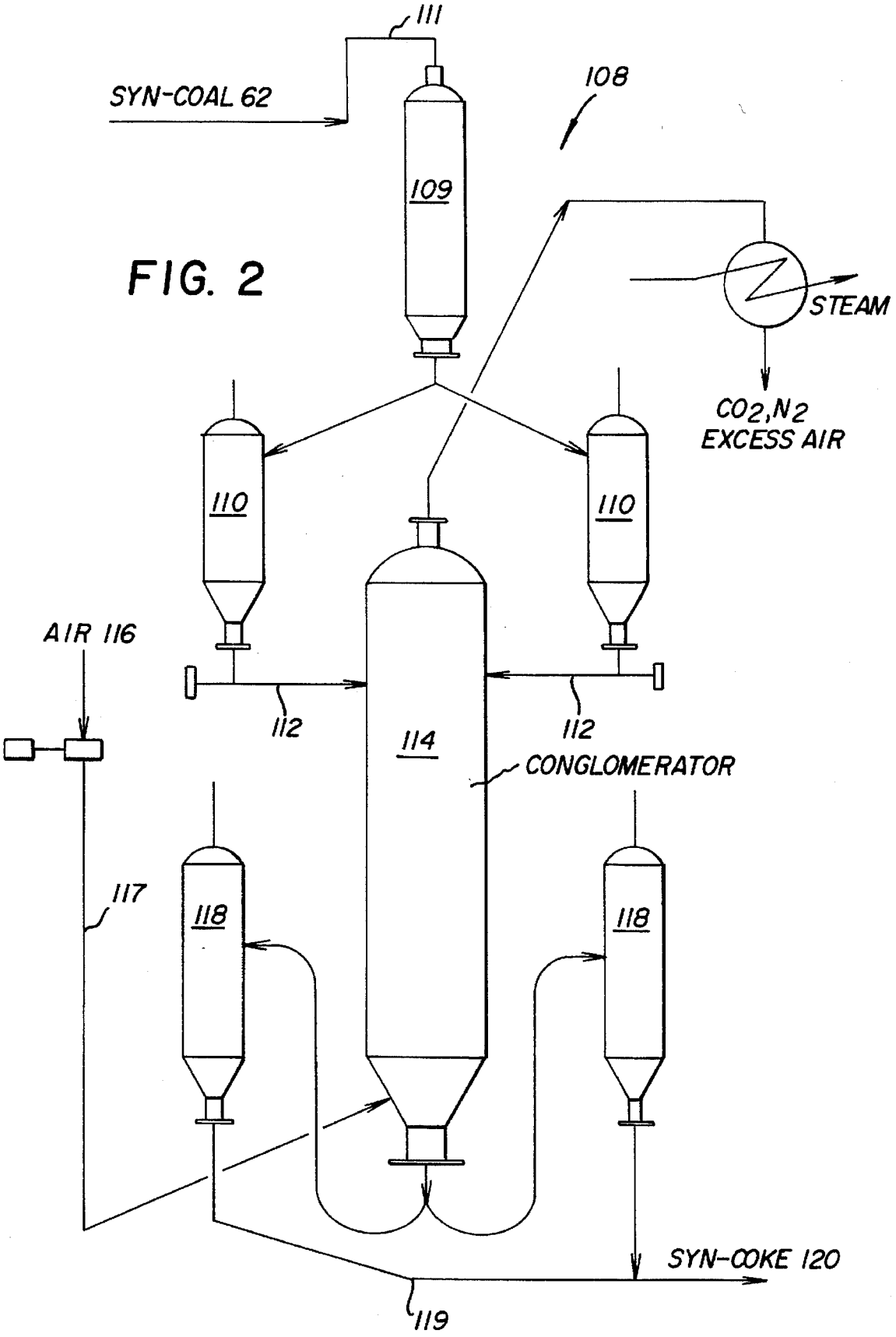
FIG. 2 is a schematic drawing of components of the synthetic coal conglomeration unit of the solid gasification process and system of the present invention.

Further economic improvement can be made by further downstream processing of the syn-coal 62 withdrawn from the fluidized bed 26 of the gasifier 20. Referring now to FIG. 2, there is shown a syn-coal conglomeration system 108. Simply, the system 108 processes the syn-coal 62 in order to form lump coke 120 having direct commercial utility. Generally, coke is a solid carbonaceous residue having no volatile material which is a common fuel source used in manufacturing steel. The lump coke of the present invention can replace metallurgical coke for burning in steel blast furnaces. The lump coke 120 of the present invention is produced at approximately one-half the production cost of metallurgical coke.

The syn-coal 62 which has been withdrawn from the fluidized bed 26 of the gasifier 20 is first delivered to a temporary storage vessel (not shown) from which a portion of the syn-coal is delivered to the limestone calcinator 36 as previously described with reference to FIG. 1. Most of the syn-coal 62, however, is withdrawn and delivered, via line 111, to hopper 109. The syn-coal 62 is then gravitated into at least a pair of lock-bins 110. Variable speed screw 112 drives force the powdered syn-coal 62 into a conglomerator reactor vessel 114. Compressed air 116 is additionally delivered, via line 117, to the conglomerator as a driving reactant. The air 116 then burns a sufficient amount of the carbon of the syn-coal 62 in order to melt a portion of the ash of the syn-coal 62 to conglomerate the syn-coal 62 into lump coke. The heavier lump coke then gravitates into the lock-bins 118. The lump coke 120 is then withdrawn and delivered, via line 119, to a storage facility for transport to a commercial site.

The novel process and system 10 of the present invention can be further described and demonstrated with reference to several developmental test runs which have produced the identified results.

EXAMPLE I

| | |
|---|---|
| System Input | |
| reagent catalyst: $Al_2O_3.SiO_2.Na_2O$ | |
| coal feed rate (12,000 BTU coal) | 5 TPD |
| recycle reagent withdrawn to blend | 1 TPD |
| Product Yields | |
| 225 BTU gas | 4.5 MMBTU/hr. |
| CaS | .38 TPD |
| heavy metal concentrate | .03 TPD |
| ash | .43 TPD |
| Operating Parameters | |
| gasifier pressure | 175 psig |
| gasifier temperature profile | 875–1650° F. |
| calciner air-$CO_2$ to gasifier | 1700° F. |
| syn-coal recycle to gasifier | 1650° F. |
| syn-coal external heater vent | 1800° F. |
| oxygen source | |
| from air | 34% |
| from steam | 28% |
| from $CO_2$ | 38% |

EXAMPLE II

| | |
|---|---|
| System Input | |
| reagent catalyst: $Al_2O_3.SiO_2.Na_2O$ | |
| coal feed rate (12,000 BTU coal) | 10 TPD |
| recycle reagent withdrawn to blend | 2 TPD |
| Product yields | |
| 225 BTU gas | 4.5 MMBTU/hr. |
| syn-coal | 4.1 TPD |
| CaS | .75 TPD |
| heavy metal concentrate | .06 TPD |
| ash | .40 TPD |
| Operating Parameters | |
| gasifier pressure | 175 psig |
| temperature profile | 870–1700° F. |
| calciner air-$CO_2$ to gasifier | 1660° F. |
| syn-coal recycle to gasifier | 1620° F. |
| syn-coal external heater vent | 1810° F. |

EXAMPLE III

System Input same as Example I except Illinois coal containing organic chlorine was the feed stock product yields same as Example I Operating Parameters same as Example I Disposition of Chlorine 1. add sufficient $BaCO_3$ to Lime treating zone
2. during gasification and hot treating the following reaction occurs:

$$2\ HCl + BaCO_3 \rightarrow BaCl_2 + H_2O + CO_2$$

3. add external cold air fluidized bed to separate out $BaCl_2$ from $CaCO_3$ and excess CaO
4. the specific gravity of elements is as follows:

| | |
|---|---|
| $BaCl_2$ | 3.856 |
| $BaCO_3$ | 4.43 |

-continued

| | |
|---|---|
| CaO excess | 3.346 |
| $CaCO_3$ | 2.93 or 2.71 |

the $BaCl_2$ and excess $BaCO_3$ have commercial value and can be utilized in chemical plant operations In order to determine the quality of the product syn-coal of the above developmental runs, several test were performed. A magnet test indicated that no heavy metals were present. A chemical test indicated that no sulfur, tar oils, water, or halogens were present in the product syn-coal. The production of a syn-coal by-product free of contaminates is a substantial improvement over prior art systems. The novel process and system of the present invention allows for the production of a valuable reaction by-product having direct commercial value.

The process and system 10 of the present invention provides for an economical way to produce a medium grade BTU gas product which has direct commercial utility. Significantly, the process and system 10 of the present invention does not require the use of manufactured oxygen. The source of in-process oxygen is derived from steam, $CO_2$, and air through carbon reactions. In avoiding the requirement of manufactured oxygen, the process and system 10 of the present invention can produce medium BTU gas having direct commercial utility at substantially reduced cost. Moreover, in using the novel catalytic reagent of the present invention, the need for complex and cost prohibitive post reaction separation hardware is avoided. The novel process and system of the present invention thereby reduces capital cost to about one-third and product production cost to about one-half. In this, the process and system 10 of the present invention can be commercialized by a wide variety of electrical producers, manufacturing companies, coal deposit owners, and the like in order to produce medium grade BTU gas having direct commercial utility. The process and system 10 of the present invention provides for an economical way to produce medium BTU gas having direct commercial utility which, when commercialized, would provide an incentive for product manufacturers (e.g. automobile manufactures) to increase product production for products which operate from clean gas. The process and system 10 of the present invention provides for an economical way to utilize the world's most abundant fuel source (viz. coal) in order to produce medium BTU gas having direct commercial utility. The synergistic relationship between the four reaction zones allows for an increase in thermal efficiency over the prior art systems from approximately 72% (prior art systems) to 89%.

Moreover, the process and system 10 of the present invention provides an economical way to produce medium BTU gas having direct commercial utility with virtually no solid or liquid waste products. The process and system 10 of the present invention provides for maximum usage of the system by-products in order to create additional products having commercial value.

SUMMARY OF MAJOR ADVANTAGES OF THE INVENTION

After reading and understanding the foregoing detailed description of a catalytic gasification process and system for the production of medium grade BTU gas in accordance with preferred embodiments of the invention, it will be appreciated that several distinct advantages of the subject process and system for the production of medium grade BTU gas are obtained.

Without attempting to set forth all of the desirable features of the instant gasification process and system for the production of medium grade BTU gas, at least some of the major advantages include providing a gasification reactor vessel 20 having four reaction zones 22, 24, 26, and 28. In the first reaction zone 22, air gasification of the carbon of the fine coal 13 occurs yielding a low BTU gas in an upward fluidization mode. Moreover, the air jet 32 strikes the dried pulverized coal 13, reagent 15, and recycled syn-coal 42 to deposit the carbon from the coal onto the coal ash, catalytic reagent 15, and recycled syn-coal 42. In the second reaction zone 24, superheated steam gasification of the carbon deposited on the hot recycle reagent 15 occurs yielding high grade BTU gas (e.g. approximately 300 BTU/C.F.). The steam gasification occurs in a downward percolation mode for the solid particles and an upward flow for the product gas. The system reagent 15 is selected so as to provide circulation through both the inner and outer reaction zone in order to balance the exothermic heat of the inner reaction (1) and the endothermic heat of the outer reaction (2). Moreover, the catalytic recycle reagent should have an intermediate density which is greater than that of synthetic coal in order to allow for the formation of the floating synthetic coal bed 26. The reagent is selected to permit chemical bonding between the reagent and the catalytic agent. The preferred recycle reagent of the present invention is sillimanite $Al_2O_3 \cdot SiO_2$.

In the third reaction zone 26, the carbon of the syn-coal is reacted with residual $CO_2$ in order to increase the production of high grade BTU gas and produce additional endothermic reaction heat for heat recovery. This sequential cooling improves plant efficiency. A deep syn-coal fluidized bed is maintained which allows for withdrawal of syn-coal as a clean by-product for further downstream production in a syn-coal conglomeration unit 108. Moreover, syn-coal is withdrawn from the third reaction zone 26 for recycling back into the inner reaction zone 22. In the upper lime treating zone 28, contaminate $H_2S$ gas in converted into a useful and manageable by-product CaS 70 which may be easily removed from the system.

Gasification support reactor vessels include a recycle syn-coal heating vessel 40 and a limestone calcinator vessel 36. In the recycle syn-coal heating vessel 40, the syn-coal from reaction zone 26, withdrawn through line 46, is superheated through air burning of a portion of the carbon on the recycle syn-coal and re-introduced into the first reaction zone 22 thereby providing increased reaction heat. Moreover, contaminate reaction gases $N_2$ and $CO_2$ are easily and safely removed from the top of the reactor vessel 40 thereby avoiding contamination of the product gas 84. In the limestone calcinator vessel 36, the necessary process air 32 is superheated and delivered, via line 38, to the inner reaction zone 22. Compressed air 64 and syn-coal 62 is injected into the reaction vessel 36 to simultaneously calcine limestone whereby lime and ash are formed as by-products and the hot air and $CO_2$ gas are diverted out of the top of the vessel 36. The process and system of the present invention provides for further process flexibility by allowing the syn-coal 62 to be withdrawn from the third reaction zone 26 for direct use or diverted to a syn-coal conglomeration unit 108 for producing lump coke 120 to be used in steel blast furnace operations.

In describing the invention, reference has been made to a preferred embodiment and illustrative advantages of the invention. Those skilled in the art, however, and familiar with the instant disclosure of the subject invention, may recognize additions, deletions, modifications, substitutions and other changes which fall within the purview of the subject invention.

What is claimed:

1. A solid catalytic gasification process for the production of a medium grade BTU gas comprising the steps of:

delivering a blended mixture of a solid carbonaceous fuel and a catalytic reagent to a first reaction zone of a gasification reaction vessel, said catalytic reagent comprising a process reagent and an alkali metal, said process reagent selected from the group consisting of sillimanite or mullite and having an intermediate density that is low enough to permit fluidization and that is greater than that of synthetic coal;

delivering hot air at a temperature in a range in the order of about 1650° to 1700° F. into a first reaction zone of the gasification reaction vessel such that oxygen of the air reacts with carbon of the solid carbonaceous fuel in an exothermic reaction creating a low grade BTU gas primarily consisting of carbon monoxide (CO) and nitrogen ($N_2$) gas, said hot air further causing deposition of the carbon of the solid carbonaceous fuel on the catalytic reagent and the product ash, thereby creating synthetic coal, whereby the synthetic coal and low grade BTU gas gravitate to a third reaction zone of the reaction vessel, and the catalytic reagent flows into a second reaction zone of said gasification reaction vessel;

delivering steam to the second reaction zone of the gasification vessel such that carbon deposited on the catalytic reagent reacts with the oxygen in the steam to create high grade BTU gas consisting primarily of hydrogen ($H_2$) and carbon monoxide (CO) gas which flows into the third reaction zone of the gasification vessel;

whereby the low grade BTU gas is mixed with the high grade BTU gas to form a clean medium grade BTU gas having direct commercial utility which is withdrawn from the reaction vessel.

2. A solid gasification process as defined in claim 1 further comprising the steps of the withdrawing a portion of the synthetic coal from the third reaction zone and delivering the withdrawn synthetic coal to a synthetic coal heating vessel and, in turn, withdrawing a heated recycled synthetic coal, and delivering the recycled synthetic coal into the first reaction zone of the gasification vessel thereby providing an increase in reaction heat whereby the rate of withdrawal is controlled depending on the amount of process heat desired in the first reaction zone.

3. A solid gasification process as defined in claim 2 further comprising the step of delivering air to the synthetic coal heating vessel in order react the carbon of the synthetic coal in an exothermic reaction to primarily form carbon dioxide ($CO_2$) and nitrogen ($N_2$) product gas and withdrawing the product gas from the heating vessel.

4. A solid gasification process as defined in claim 2 further comprising the step of withdrawing another portion of the synthetic coal from the third reaction zone of the gasification reaction vessel as a clean by-product having commercial utility.

5. A solid gasification process as defined in claim 1 further comprising the steps of:

delivering lime (CaO) to a fourth reaction zone of the gasification vessel such that the lime reacts with a contaminant gas ($H_2S$) to produce a clean product (CaS) which gravitates to an upper portion of the fourth reaction zone;

withdrawing the CaS product from the upper portion of the fourth reaction zone as a clean by-product; and withdrawing limestone ($CaCO_3$) from a lower portion of the fourth reaction zone.

6. A solid gasification process as defined in claim 5 further comprising the steps of:

delivering the limestone ($CaCO_3$) withdrawn from the lower portion of the fourth reaction zone to a limestone calcinator vessel;

delivering a portion of the synthetic coal which has been withdrawn from the third reaction zone of the gasification vessel to the limestone calcinator vessel;

delivering air to the limestone calcinator such that the oxygen content of the air reacts with the carbon of the synthetic coal in an exothermic reaction to form a hot carbon dioxide ($CO_2$) and air product;

withdrawing the hot carbon dioxide ($CO_2$) and air product and delivering the product to the first reaction zone of the gasification vessel as the hot air delivered thereto; and withdrawing a lime (CaO) by-product from the calcinator vessel and delivering the product to the fourth reaction zone of the gasification vessel withdrawing an ash by-product from the lime calcinator vessel.

7. A solid gasification process as defined in claim 1 further comprising the step of withdrawing a portion of the catalytic reagent from the first and second reaction zones and recycling the withdrawn catalytic reagent back to a mixing device for blending with the solid carbonaceous fuel.

8. A solid gasification process as defined in claim 1 further comprising the step of withdrawing heavy metal contaminants through a lower portion of the gasification reaction vessel for safe removal.

9. A solid gasification process as defined in claim 1 wherein the solid carbonaceous fuel is coal.

10. A solid gasification process as defined in claim 1 wherein the process reagent is sillimanite ($Al_2O_3 \cdot SiO_2$).

11. A solid gasification process as defined in claim 10 wherein the sillimanite ($Al_2O_3 \cdot SiO_2$) reagent is chemically bonded with said alkali metal in order to form a catalytic process reagent.

12. A solid gasification process as defined in claim 11 wherein the alkali metal is sodium (Na) thereby yielding a catalytic reagent ($Al_2O_3 \cdot SiO_2 \cdot Na_2O$).

13. A solid gasification process as defined in claim 11 wherein the alkali metal is potassium (K) thereby yielding a catalytic reagent ($Al_2O_3 \cdot SiO_2 \cdot K_2O$).

14. A solid gasification process as defined in claim 11 wherein the catalytic reagent consist of 75% wt. sillimanite and 25% wt. alkali metal.

15. A solid gasification process as defined in claim 1 wherein the process reagent is mullite ($3Al_2O_3 \cdot 2SiO_2$).

16. A solid gasification process as defined in claim 15 wherein the mullite ($3Al_2O_3 \cdot 2SiO_2$) reagent is chemically bonded with said alkali metal in order to form a catalytic process reagent.

17. A solid gasification process as defined in claim 1 wherein the reactions occurring in the reaction vessel are conducted at a pressure in the range of 150 to 200 p.s.i.g.

18. A solid gasification process as defined in claim 1 wherein the reactions occurring in the reaction vessel provide a vessel temperature profile in the range of 850°–1700° F.

* * * * *